US010470525B2

(12) United States Patent
Chen

(10) Patent No.: US 10,470,525 B2
(45) Date of Patent: Nov. 12, 2019

(54) APPARATUS AND METHOD FOR TIGHTENING AND LOOSENING LACE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 364 days.

(21) Appl. No.: 15/508,493

(22) PCT Filed: Sep. 5, 2014

(86) PCT No.: PCT/CN2014/085985

§ 371 (c)(1),
(2) Date: Mar. 3, 2017

(87) PCT Pub. No.: WO2016/033792

PCT Pub. Date: Mar. 10, 2016

(65) Prior Publication Data

US 2017/0295888 A1 Oct. 19, 2017

(51) Int. Cl.
*A43C 11/16* (2006.01)
*A43C 7/00* (2006.01)

(52) U.S. Cl.
CPC ..... *A43C 11/165* (2013.01); *A43C 7/00* (2013.01)

(58) Field of Classification Search
CPC ..... A43C 11/165; A43C 7/00; Y10T 24/2183
See application file for complete search history.

(56) References Cited

U.S. PATENT DOCUMENTS 8,231,074 B2 * 7/2012 Hu ..... A43C 11/165 24/68 SK
8,235,321 B2 * 8/2012 Chen ..... A43C 7/00 24/68 SK
8,245,371 B2 * 8/2012 Chen ..... A43C 7/00 24/68 B
8,468,657 B2 * 6/2013 Soderberg ..... A43C 11/16 24/68 SK
8,516,662 B2 * 8/2013 Goodman ..... A43C 11/165 24/68 SK
9,375,053 B2 * 6/2016 Burns ..... A43C 11/165
(Continued)

FOREIGN PATENT DOCUMENTS

CN 203492894 U 3/2014
DE 102012218344 A1 4/2013
(Continued)

*Primary Examiner* — Robert Sandy
*Assistant Examiner* — Louis A Mercado
(74) *Attorney, Agent, or Firm* — CKC & Partners Co., LLC

(57) ABSTRACT

An apparatus for tightening and loosening a lace includes a base, a lace tightening and loosening member, a releasing unit and an interlocking member. A temporary sliding portion is disposed between a first positioning portion and a second positioning portion. A stopping member is passed through the temporary sliding portion by a preliminary force. When the stopping member is positioned by the first positioning portion, a second combining portion is correspondingly connected to a first combining portion. When the stopping member is positioned by the second positioning portion, the second combining portion is separated from the first combining portion. When the releasing unit is located at a first position, the elastic abutting arm substantially stops the releasing unit from rotating in a loosening direction and does not substantially stop the releasing unit from rotating in a tightening direction.

7 Claims, 12 Drawing Sheets

(56) References Cited

U.S. PATENT DOCUMENTS

| | | | | |
|---|---|---|---|---|
| 9,629,417 | B2 * | 4/2017 | Cavanagh | A43C 11/165 |
| 9,770,070 | B2 * | 9/2017 | Cotterman | A43C 11/20 |
| 10,051,920 | B2 * | 8/2018 | Chen | A43C 1/00 |
| 10,076,160 | B2 * | 9/2018 | Burns | A44B 11/065 |
| 2017/0304102 | A1 * | 10/2017 | Turrini | A61F 5/0111 |
| 2017/0325548 | A1 * | 11/2017 | Ha | A43C 11/165 |
| 2018/0257276 | A1 * | 9/2018 | Hipwood | B29C 45/14786 |

FOREIGN PATENT DOCUMENTS

| | | | |
|---|---|---|---|
| JP | 3159620 | U | 5/2010 |
| TW | I374016 | B | 10/2012 |

* cited by examiner

APPARATUS AND METHOD FOR TIGHTENING AND LOOSENING LACE

RELATED APPLICATIONS

This application is a continuation of International application No. PCT/CN2014/085985, filed Sep. 5, 2014, which is herein incorporated by reference.

BACKGROUND

Technical Field

The present disclosure relates to an apparatus and a method for tightening and loosening a lace. More particularly, the present disclosure relates to the apparatus and the method for facilitating tightening and loosening operations of the lace.

Description of Related Art

Recently, for preventing a foot from injury caused by sliding in a shoe while walking or sporting, it is particularly focused on adjusting the tightness between the foot and the shoe. In the past, common methods by using such as a shoelace, an elastic ribbon, a zipper or a Velcro tape are used to achieve this purpose. However, the Velcro tape is easily contaminated with dusts and scraps, and is easily fatigued after being used several times, thus having poor practicality; the zipper has a small adjusting range and poor fixity; and the elastic ribbon easily becomes rigid after a long time use. Accordingly, in the market, a shoelace-type shoe is most popular.

However, for children who cannot tie a shoelace, the shoelace is often loosened due to poor tightening; and for elders with decayed physical strength, it often bothers them to crouch down to tie a shoelace. More importantly, in some vigorous sport occasions such as basketball, tennis, rock climbing and skateboarding, etc., once the shoelace is loosened or the remaining shoelace is too long, a foot is easily tripped on the shoelace when being moved, or the shoelace is easily caught by a foreign matter, thus causing dangers, which cause great threats to professional athletes.

In the market, there is a fastener structure with a function of tightening or loosening a shoelace (see Taiwan Patent Serial No. 1374016). The fastener structure is popular because it can be applied on various products requiring to tighten a lace on a wearable product. Such conventional fastener structure utilizes a ring-type stopping member and an elastic member (i.e. elastic plate) to generate a uniform vertical jamming force. By the uniform vertical jamming force, a rotation motion of a cap and a vertical motion can drive a wire-plate to tighten or loosen the shoelace. However, in such fastener structure, the number of the components is large and the structure is very complicated. Moreover, the cost of the elastic member is high, and the elastic member is easily elastically fatigued after being used repeatedly. Furthermore, damages easily occur between the elastic member and the other components that are resisted by the elastic member. Thus, the operation fault and the failure rate will increase.

SUMMARY

The present disclosure provides an apparatus for tightening and loosening a lace with simple structure, lost cost, easy assembly and easy operation. Moreover, the present disclosure can avoid excessive wear and failure of the reciprocating operation without a conventional single elastic unit structure.

According to one aspect of the present disclosure, an apparatus for tightening and loosening a lace includes a base, a lace tightening and loosening member, a releasing unit and an interlocking member. The base has an accommodating space and at least one stopping member. The accommodating space is communicated with an ambience by two lacing holes. The lace tightening and loosening member is pivotally mounted in the accommodating space. The lace tightening and loosening member includes an annular track and a first combining portion, and the annular track is corresponding to the two lacing holes. The releasing unit is pivotally mounted in the accommodating space. The releasing unit includes a rotating knob, a plurality of annular teeth, a second combining portion, a first positioning portion, a second positioning portion and a temporary sliding portion. The temporary sliding portion is disposed between the first positioning portion and the second positioning portion. The temporary sliding portion is passed through the stopping member by a preliminary force. When the stopping member is positioned by the first positioning portion, the releasing unit is located at a first position, and the second combining portion is correspondingly connected to the first combining portion. When the stopping member is positioned by the second positioning portion, the releasing unit is located at a second position, and the second combining portion is separated from the first combining portion. The interlocking member is fixedly disposed in the accommodating space. The interlocking member includes at least one elastic abutting arm corresponding to the annular teeth. When the releasing unit is located at the first position, the elastic abutting arm substantially stops the releasing unit from rotating in a loosening direction and does not substantially stop the releasing unit from rotating in a tightening direction.

In one embodiment, the annular teeth include a plurality of outer annular teeth and a plurality of inner annular teeth protruding toward the base. A plurality of elastic abutting arms are integrally connected to the interlocking member. Each of the elastic abutting arms has a sliding block and a resisting end. The resisting end is configured to apply a blocking force to the inner annular teeth, and the sliding block connected to the resisting end substantially stops the inner annular teeth from rotating in the loosening direction and does not substantially stop the inner annular teeth from rotating in the tightening direction. Therefore, each of the resisting ends combined with a blocking force applied by the annular teeth can effectively prevent accidental operations. For example, when the release unit is moved, there is a strong releasing reactive force generated by the lace, and the present disclosure may use the blocking force to operate as a buffer.

Furthermore, in another embodiment, the interlocking member has a hollow ring shape. A plurality of elastic supporting seats are protrudingly disposed in the interlocking member at equal intervals. The elastic abutting arms are connected to the elastic supporting seats, respectively. One of the elastic abutting arms connected to one of the elastic supporting seats is protrudingly formed along the interlocking member. Each of the outer annular teeth has a stopping surface. Each of the inner annular teeth has an inclined stopping surface. The stopping surface is opposite to the inclined stopping surface. Each of the sliding blocks has a plane surface corresponding to the stopping surface. Each of the resisting ends has a tilted surface corresponding to the inclined stopping surface.

According to another aspect of the present disclosure, a method for operating an apparatus for tightening and loosening a lace is provided. The method includes that the releasing unit is operated to dispose at the first position. The rotating knob of the releasing unit is rotated relative to the interlocking member in the loosening direction. The lace tightening and loosening member is moved by the releasing unit to tighten the lace along the annular track. The releasing unit is operated to dispose at the second position. Finally, a force is applied to the lace so as to freely rotate the lace tightening and loosening member and release the lace.

According to further another aspect of the present disclosure, an apparatus for tightening and loosening a lace includes a base, a lace tightening and loosening member, a releasing unit and an interlocking member. The base has an accommodating space and at least one stopping member. The accommodating space is communicated with an ambience by two lacing holes. The lace tightening and loosening member is pivotally mounted in the accommodating space. The lace tightening and loosening member includes an annular track and a first combining portion, and the annular track is corresponding to the two lacing holes. The releasing unit is pivotally mounted in the accommodating space with the lace tightening and loosening member. The releasing unit in order from outside to inside includes a rotating knob, a plurality of annular teeth, a second combining portion, a first positioning portion, a temporary sliding portion and a second positioning portion. The rotating knob is configured to operate in an axial reciprocating motion. The temporary sliding portion is passed through the stopping member by an axial preliminary force. When the stopping member is positioned by the first positioning portion, the releasing unit is located at a first position, and the second combining portion is correspondingly connected to the first combining portion. When the stopping member is positioned by the second positioning portion, the releasing unit is located at a second position, and the second combining portion is separated from the first combining portion. The interlocking member is fixedly disposed in the accommodating space. The interlocking member includes an elastic abutting arm corresponding to the annular teeth. The elastic abutting arm is configured to operate in the axial reciprocating motion. When the releasing unit is located at the first position without rotation, the elastic abutting arm substantially stops the releasing unit from rotating in a loosening direction and does not substantially stop the releasing unit from rotating in a tightening direction.

According to the above-mentioned aspect of the present disclosure, the releasing unit only needs to be simply moved in the axial reciprocating motion, thus easily loosening or tightening the lace on a wearable product.

According to still further another aspect of the present disclosure, an apparatus for tightening and loosening a lace includes a base, a lace tightening and loosening member, a releasing unit and an interlocking member. The base has a plurality of base annular teeth, an accommodating space and at least one stopping member. The accommodating space is communicated with an ambience by two lacing holes. The lace tightening and loosening member is pivotally mounted in the accommodating space. The lace tightening and loosening member includes an annular track and a first combining portion, and the annular track is corresponding to the two lacing holes. The releasing unit is pivotally mounted in the accommodating space and operated by a user. The releasing unit includes a plurality of releasing annular teeth, a first positioning portion, a second positioning portion and a temporary sliding portion. The temporary sliding portion is disposed between the first positioning portion and the second positioning portion. The temporary sliding portion is passed through the stopping member by a preliminary force. The interlocking member is rotatably positioned in the accommodating space. The interlocking member includes an elastic abutting arm and a second combining portion, and the elastic abutting arm is correspondingly engaged with the base annular teeth. When the stopping member is positioned by the first positioning portion, the releasing unit is located at a first position without rotation, and the second combining portion is correspondingly connected to the first combining portion. The elastic abutting arm substantially stops the releasing unit from rotating in a loosening direction and does not substantially stop the releasing unit from rotating in a tightening direction. When the stopping member is positioned by the second positioning portion, the releasing unit is located at a second position, the second combining portion is separated from the first combining portion.

In one embodiment, the interlocking member has a plurality of elastic abutting arms extending outward from the interlocking member. Each of the elastic abutting arms is correspondingly abutted or released by one of the releasing annular teeth, so that the elastic abutting arms is operated in a reciprocating motion with radial shrinkage and expansion. When the releasing unit is located at the first position, each of the elastic abutting arms are abutted or released by the releasing annular teeth. When the releasing unit is not rotated, the elastic abutting arms substantially stop the releasing unit from rotating in the loosening direction and do not substantially stop the releasing unit from rotating in the tightening direction. When the releasing unit is rotated, the elastic abutting arms substantially allow the releasing unit to progressively rotate in the loosening direction.

According to the above-mentioned aspect of the present disclosure, the apparatus for tightening and loosening the lace can be easily assembled, easily operated without a function of an elastic unit. Moreover, the present disclosure can reduce complexity of the apparatus and the number of components, thereby decreasing the cost of the product.

DETAILED DESCRIPTION

Figure 1:
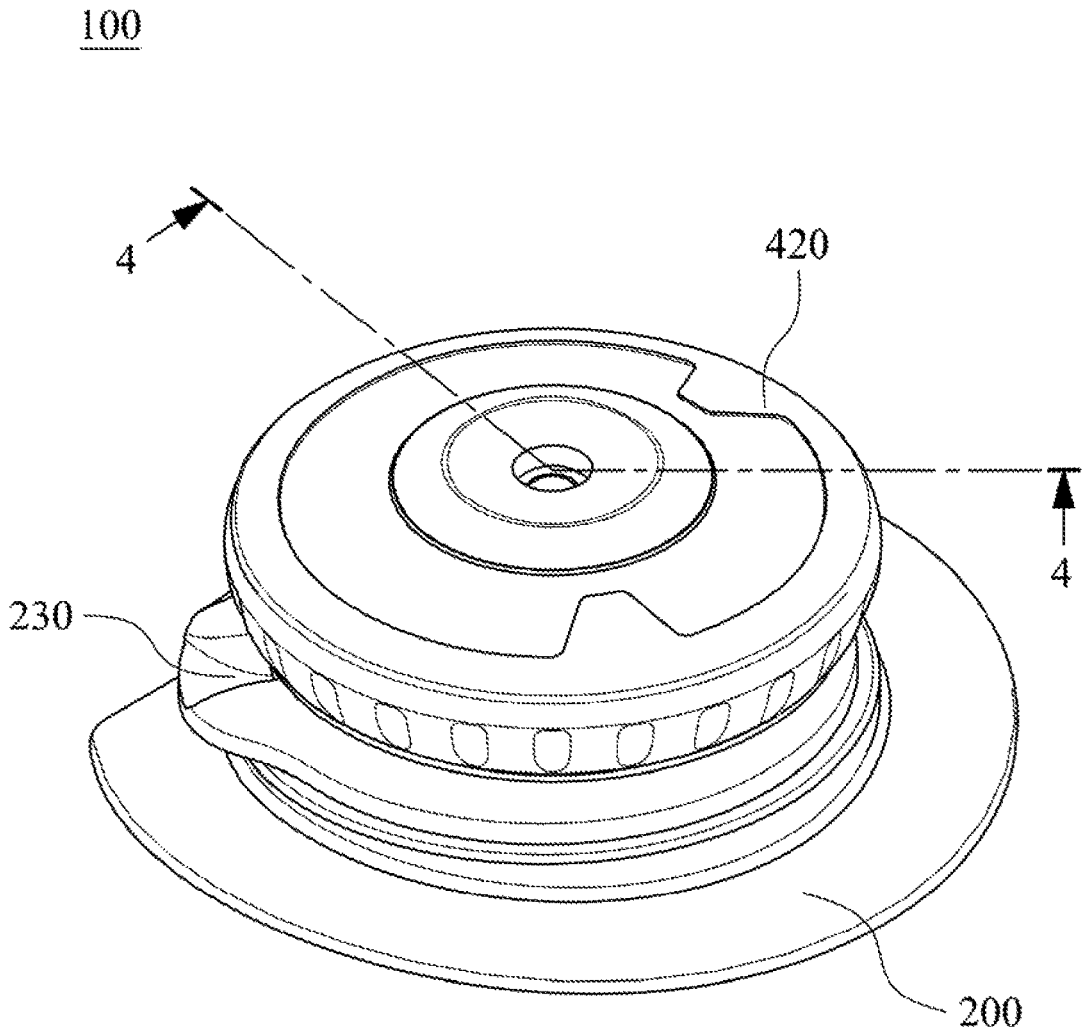
FIG. 1 is a schematic view showing an apparatus for tightening and loosening a lace according to one embodiment of the present disclosure.
Figure 2:
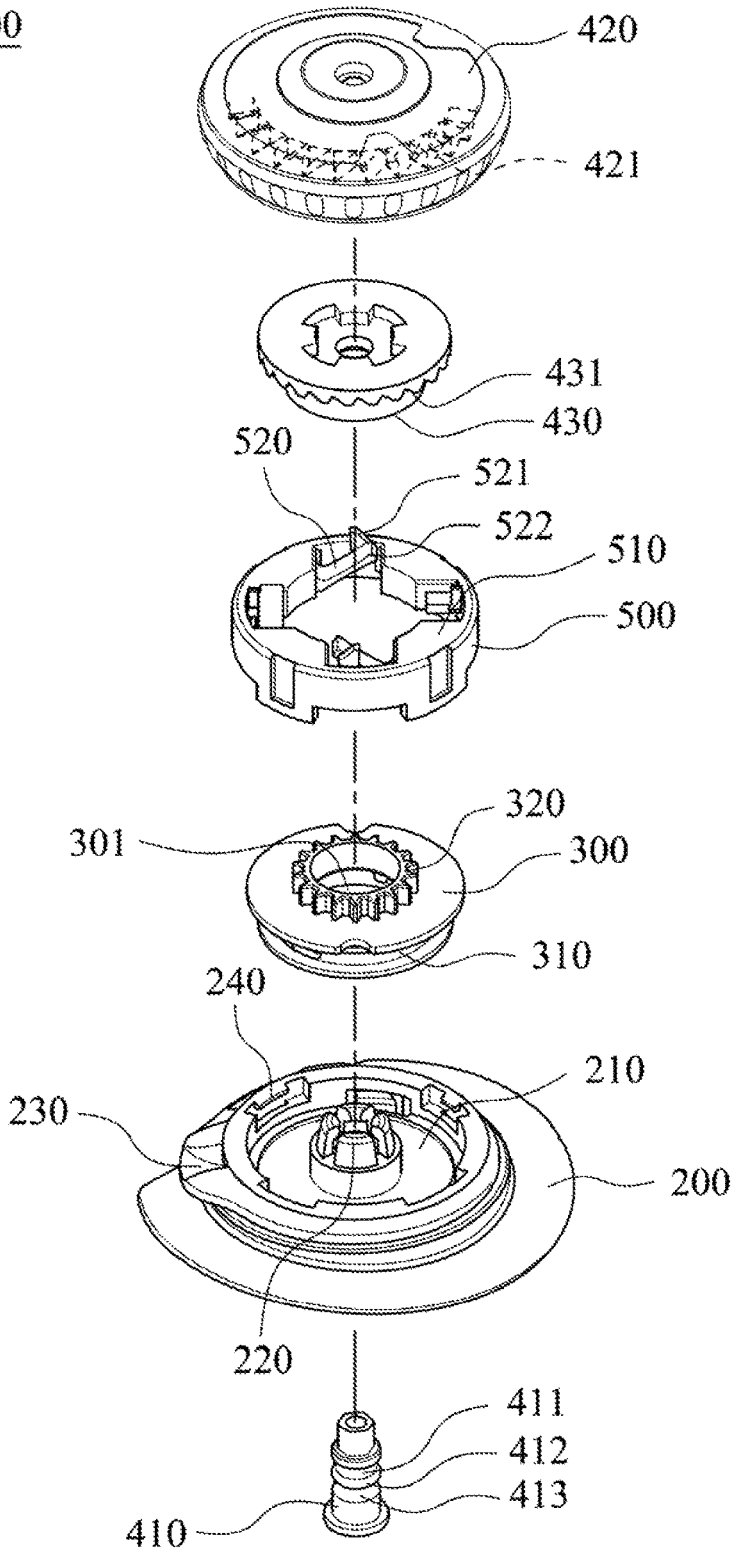
FIG. 2 is an exploded view showing the apparatus of FIG. 1.
Figure 3:
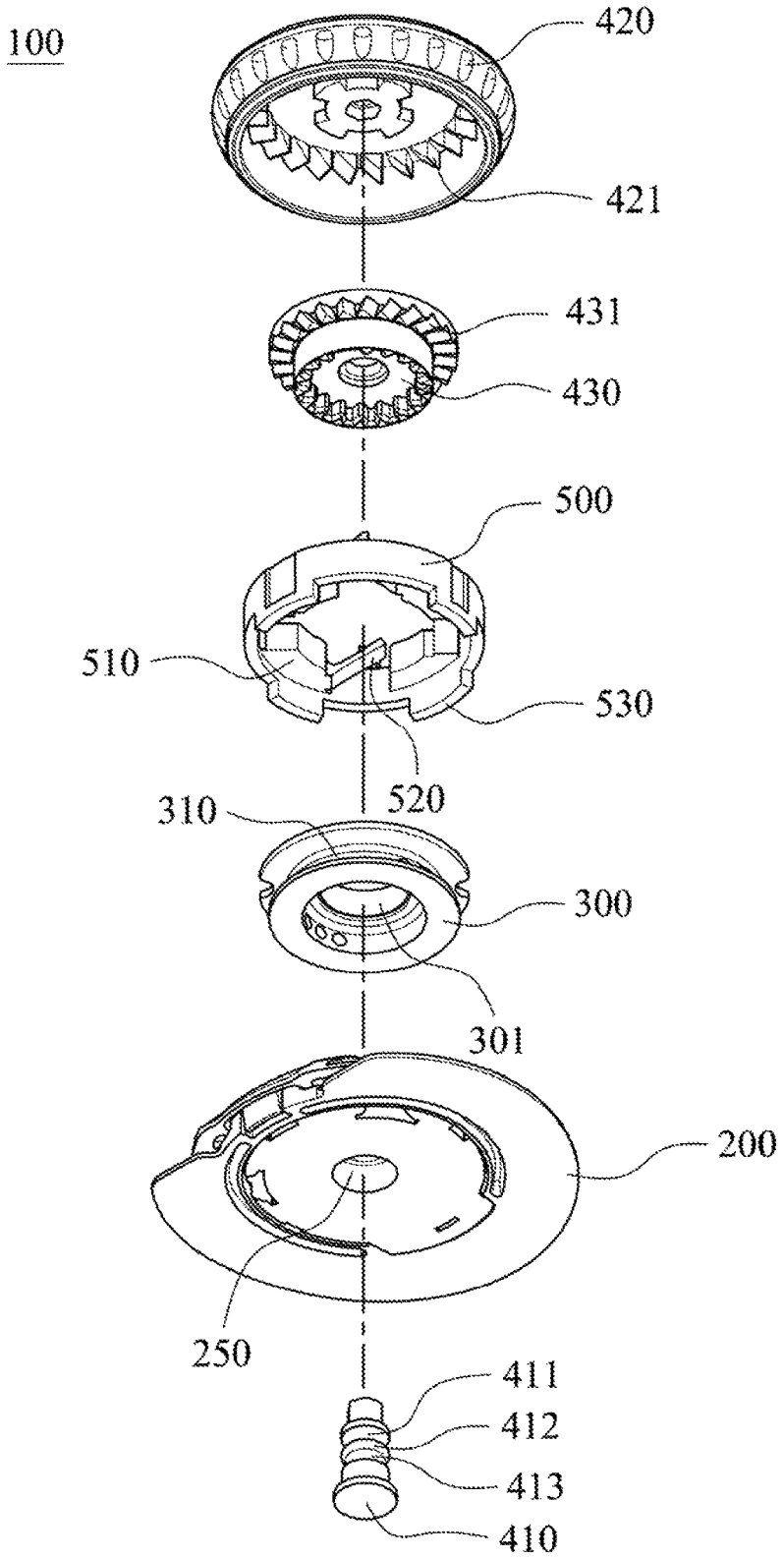
FIG. 3 is another exploded view showing the apparatus of FIG. 1.
Figure 4:
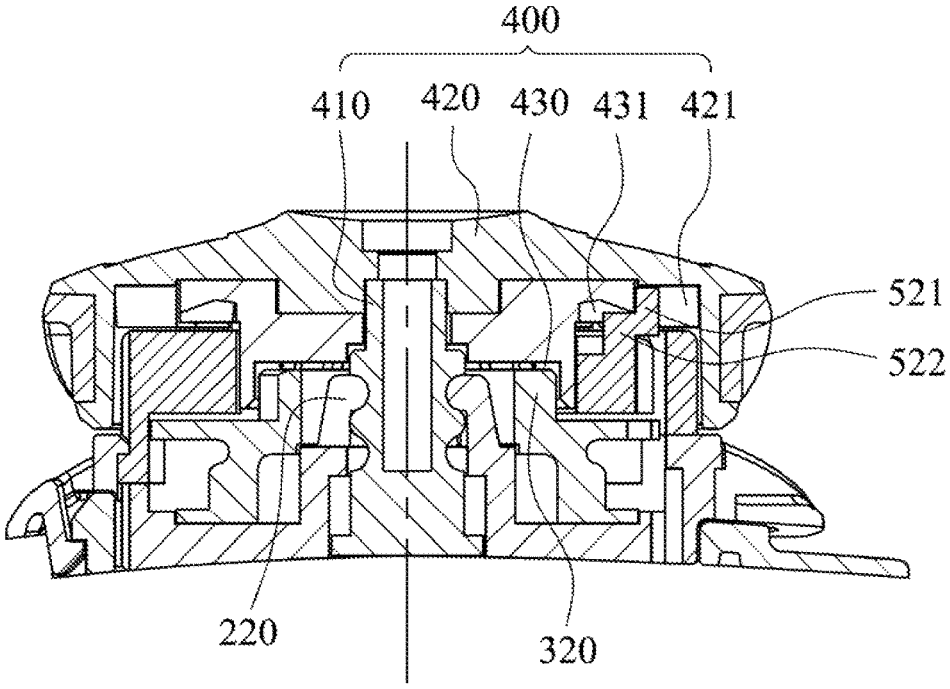
FIG. 4 is a cross-sectional view showing a releasing unit located in a first position of the apparatus of FIG. 1.
Figure 5:
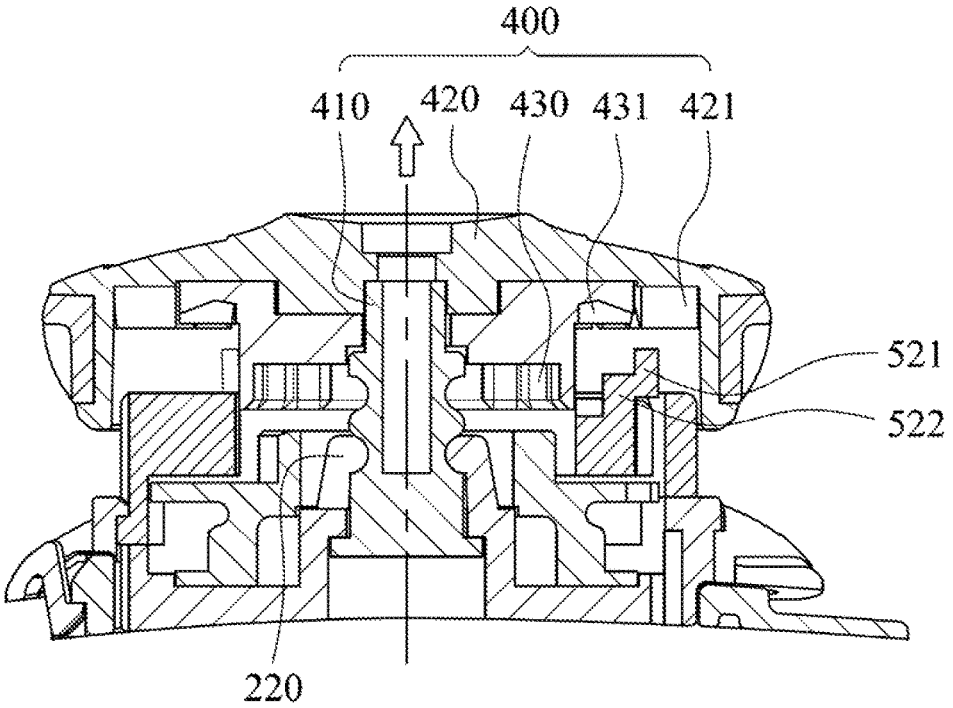
FIG. 5 is a cross-sectional view showing the releasing unit located in a second position of the apparatus of FIG. 1.

FIG. 1 is a schematic view showing an apparatus 100 for tightening and loosening a lace according to one embodiment of the present disclosure; FIG. 2 is an exploded view showing the apparatus 100 of FIG. 1; FIG. 3 is another exploded view showing the apparatus 100 of FIG. 1; FIG. 4 is a cross-sectional view showing a releasing unit 400 located in a first position of the apparatus 100 of FIG. 1; and FIG. 5 is a cross-sectional view showing the releasing unit 400 located in a second position of the apparatus 100 of FIG. 1. According to FIGS. 1-5, it should be enough to explain the structure of the embodiment of the present disclosure. The present disclosure provides the apparatus 100 for tightening and loosening the lace which includes a base 200, a lace tightening and loosening member 300, the releasing unit 400 and an interlocking member 500.

The base 200 has an accommodating space 210 and at least one stopping member 220. The accommodating space 210 is communicated with an ambience by two lacing holes 230. Four concave portions 240 are disposed around the accommodating space 210 of the base 200. The stopping member 220 includes a plurality of claw portions corresponding to a central axis of the base 200, and a through hole 250 is formed in a center of the stopping member 220.

The lace tightening and loosening member 300 is pivoted outside of the stopping member 220 via a pivoting hole 301. The lace tightening and loosening member 300 is pivotally mounted in the accommodating space 210. The lace tightening and loosening member 300 includes an annular track 310 and a first combining portion 320. The annular track 310 is corresponding to the two lacing holes 230. The first combining portion 320 of the lace tightening and loosening member 300 is disposed over and around the pivoting hole 301. The first combining portion 320 has a convex radiating teeth shape.

The releasing unit 400 includes a shaft member 410 which is passed through the pivoting hole 301 of the lace tightening and loosening member 300 and the through hole 250 of the base 200, so that the releasing unit 400 is pivotally mounted in the accommodating space 210 with the lace tightening and loosening member 300. The releasing unit 400 further includes a rotating knob 420 and a second combining portion 430 engaged with the rotating knob 420. The second combining portion 430 is correspondingly connected to the first combining portion 320. The rotating knob 420, the second combining portion 430 and the shaft member 410 are connected in order from outside to inside, and then can be operated in an axial reciprocating motion in the accommodating space 210. A plurality of outer annular teeth 421 are disposed on the rotating knob 420, and the shaft member 410 has a first positioning portion 411, a temporary sliding portion 412 and a second positioning portion 413 in order from top to bottom. A plurality of inner annular teeth 431 are disposed outside of the second combining portion 430. The outer annular teeth 421 and the inner annular teeth 431 protrude in the axial direction toward the base 200. The claw portions of the stopping member 220 can be positioned by the first positioning portion 411 and the second positioning portion 413. The temporary sliding portion 412 is passed through the stopping member 220 by a preliminary force so as to switch the stopping member between the first positioning portion 411 and the second positioning portion 413. When the stopping member 220 is positioned by the first positioning portion 411, the releasing unit 400 is located at a first position, and the second combining portion 430 is correspondingly connected to the first combining portion 320. When the stopping member 220 is positioned by the second positioning portion 413, the releasing unit 400 is located at a second position, and the second combining portion 430 is separated from the first combining portion 320.

The interlocking member 500 has a hollow ring shape. Four elastic supporting seats 510 are protrudingly disposed in the interlocking member 500 at equal intervals. The elastic abutting arms 520 are connected to the elastic supporting seats 510, respectively. One of the elastic abutting arms 520 connected to one of the elastic supporting seats 510 is protrudingly formed along the interlocking member 500. The interlocking member 500 includes four elastic abutting arms 520 corresponding to the outer annular teeth 421 and the inner annular teeth 431, and the elastic abutting arms 520 are configured to operate in the axial reciprocating motion. Each of the elastic abutting arms 520 is integrally connected to the interlocking member 500. Each of the elastic abutting arms 520 has a sliding block 521 and a resisting end 522. The resisting end 522 is configured to apply a blocking force to the inner annular teeth 431. When no external force is applied to the releasing unit 400, the sliding block 521 connected to the resisting end 522 substantially stops the outer annular teeth 421 from rotating in the loosening direction and does not substantially stop the outer annular teeth 421 from rotating in the tightening direction. A plurality of convex portions 530 are protrudingly disposed on the interlocking member 500, and the convex portions 530 are engaged with the concave portions 240, respectively, so that the interlocking member 500 is positioned in the accommodating space 210. Each of the outer annular teeth 421 has a stopping surface 4211. Each of the inner annular teeth 431 has an inclined stopping surface 4311 and an inclined releasing surface 4312, and the stopping surface 4211 is opposite to the inclined stopping surface 4311. Each of the sliding blocks 521 has a plane surface 5211 corresponding to the stopping surface 4211. Each of the resisting ends 522 has a tilted surface (not shown) corresponding to the inclined stopping surface 4311 and the inclined releasing surface 4312.

Figure 6:
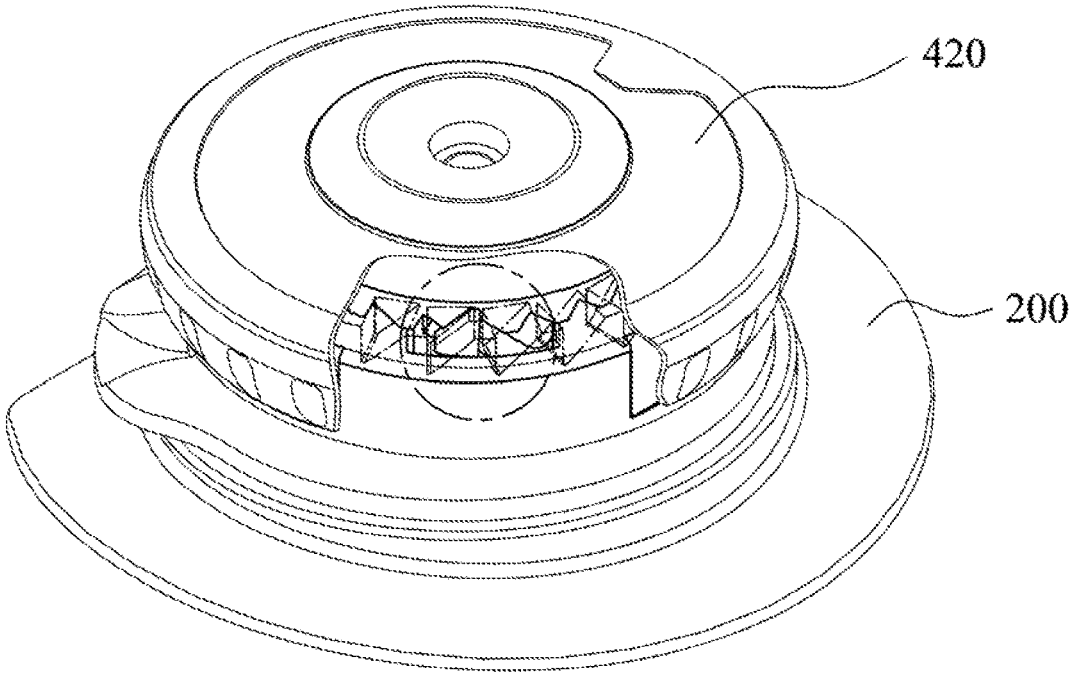
FIG. 6 is a partial perspective view showing the apparatus of FIG. 1.
Figure 7:
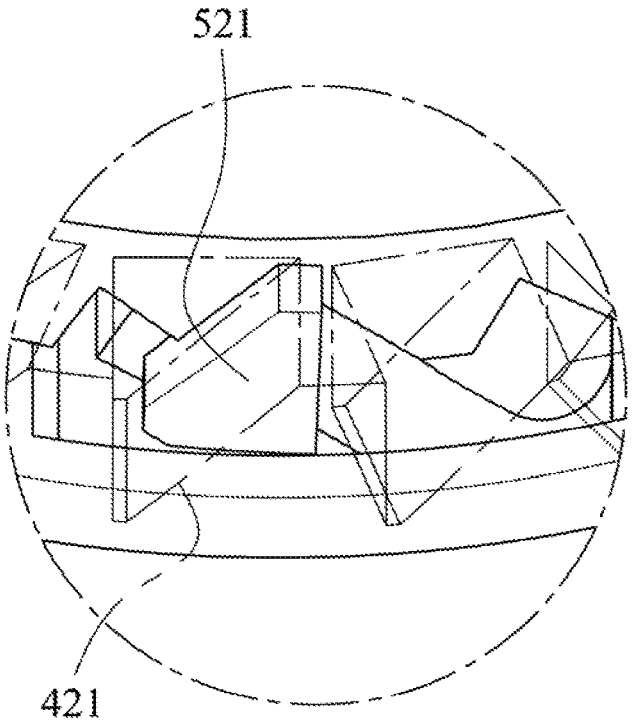
FIG. 7 is a partial enlarged view showing a sliding block and a stopping surface of the apparatus of FIG. 6.
Figure 8:
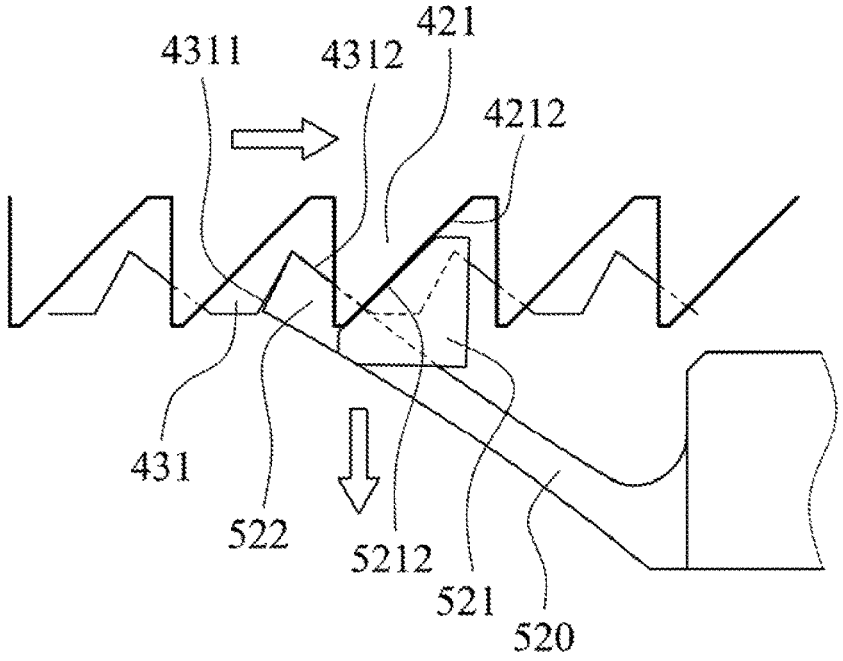
FIG. 8 is a schematic view showing an elastic abutting arm and a releasing unit rotated in a tightening direction according to the present disclosure.
Figure 9:
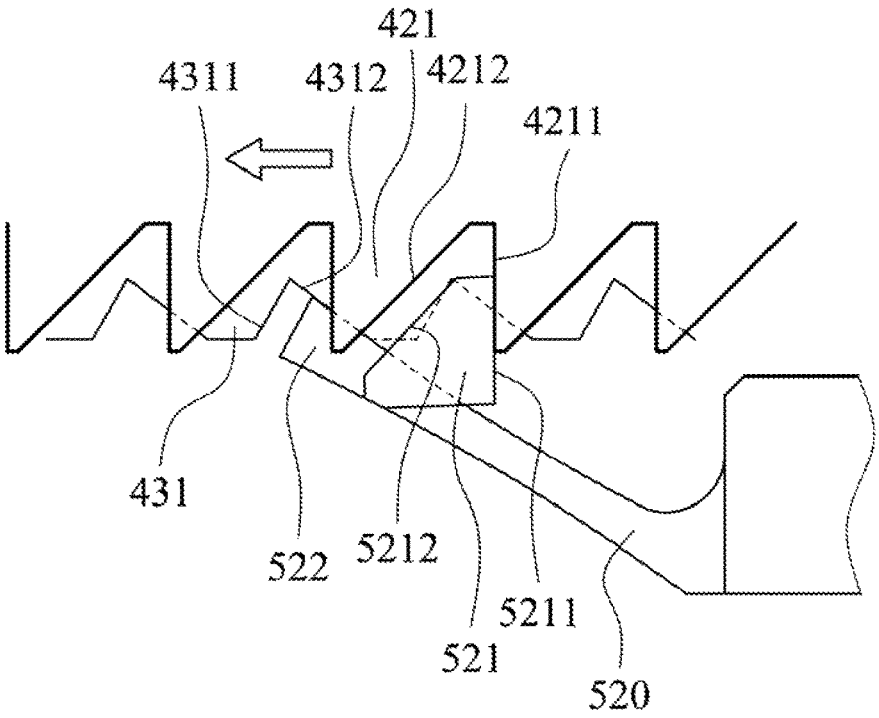
FIG. 9 is a schematic view showing an elastic abutting arm and a releasing unit rotated in a loosening direction according to the present disclosure.

FIG. 6 is a partial perspective view showing the apparatus 100 of FIG. 1; FIG. 7 is a partial enlarged view showing a sliding block 521 and a stopping surface 4211 of the apparatus 100 of FIG. 6; FIG. 8 is a schematic view showing an elastic abutting arm 520 and a releasing unit 400 rotated in a tightening direction according to the present disclosure; and FIG. 9 is a schematic view showing an elastic abutting arm 520 and a releasing unit 400 rotated in a loosening direction according to the present disclosure. When the releasing unit 400 of the present disclosure is located at the first position, the sliding block 521 connected to the resisting end 522 substantially stops the inner annular teeth 431 from rotating in the loosening direction. Accordingly, a user can easily rotate the rotating knob 420 via the second combining portion 430 correspondingly engaged with the first combining portion 320. The lace tightening and loosening member 300 is pivoted outside of the stopping member 220 via the pivoting hole 301, and rotated by the releasing unit 400. The lace (not shown) is limited in the annular track 310. At this time, the resisting end 522 is abutted by the inclined releasing surface 4312, and the elastic abutting arm 520 is elastically deformed, so that the elastic abutting arm 520 does not affect the tightening operation. When the user releases the releasing unit 400, the sliding block 521 connected to the resisting end 522 substantially stops the inner annular teeth 431 from rotating in the loosening direction, so that the lace tightening and loosening member 300 is not rotated freely to loosen the lace.

In FIG. 8, the sliding block 521 connected to the resisting end 522 stops the outer annular teeth 421 from rotating in the loosening direction. However, when the releasing unit 400 is rotated in the loosening direction by the user, an inclined surface 5212 of each of the sliding blocks 521 is correspondingly abutted by the inclined surface 4212 of each of the outer annular teeth 421. At this time, the sliding block 521 is pushed by the outer annular teeth 421 to produce a downward force according to the inclined surfaces 4212, 5212, thus elastically deforming the elastic abutting arm 520 and downwardly separating the resisting end 522 from the inclined stopping surface 4311. Therefore, the sliding block 521 combined with the resisting end 522 substantially performs a progressive releasing operation (one-by-one), thereby controllably releasing the lace in the loosening direction.

When the user wants to completely release the lace, the rotating knob 420 can be pulled upwardly in the axial direction, and then the claw portions of the temporary sliding portion 412 is passed through the stopping member 220 by an axial preliminary force. Thus, the stopping member 220 is switched from the first positioning portion 411 to the second positioning portion 413. When the stopping member 220 is positioned by the second positioning portion 413, the releasing unit 400 is located at the second position, and the second combining portion 430 is separated from the first combining portion 320. It is worth mentioning that the resisting end 522 is configured to apply a blocking force to the inner annular teeth 431. The blocking force not only can effectively prevent accidental release or operations, but also can avoid excessive impact of the strong releasing reactive force when the stopping member 220 is switched from the first positioning portion 411 to the second positioning portion 413. Hence, the present disclosure may use the blocking force to operate as a buffer and limit the movement.

After the stopping member 220 switching from the first positioning portion 411 to the second positioning portion 413, the releasing unit 400 of the present disclosure is located at the second position, and the second combining portion 430 is separated from the first combining portion 320. The lace tightening and loosening member 300 can be rotated freely to loosen the lace in the annular track without the blocking force.

The present disclosure provides a method for operating the apparatus 100 for tightening and loosening a lace on a wearable product. The method includes that the releasing unit 400 is operated to dispose at the first position. The releasing unit 400 is rotated relative to the interlocking member 500 in the loosening direction. The lace tightening and loosening member 300 is moved by the releasing unit 400 to tighten the lace along the annular track 310. The releasing unit 400 is operated to dispose at the second position. Finally, a force is applied to the lace so as to freely rotate the lace tightening and loosening member 300 and release the lace.

Figure 10:
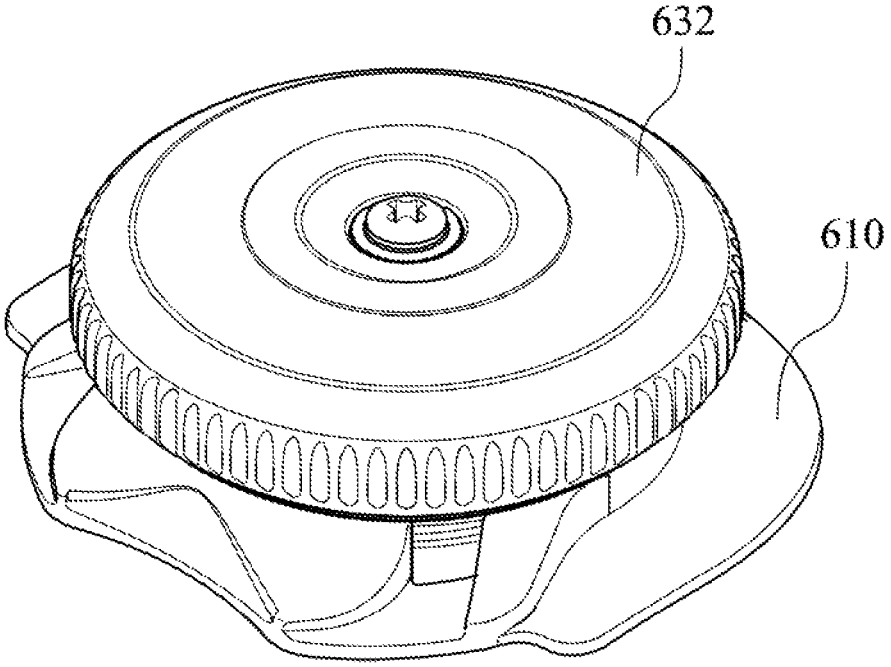
FIG. 10 is a schematic view showing an apparatus for tightening and loosening a lace according to another embodiment of the present disclosure.
Figure 11:
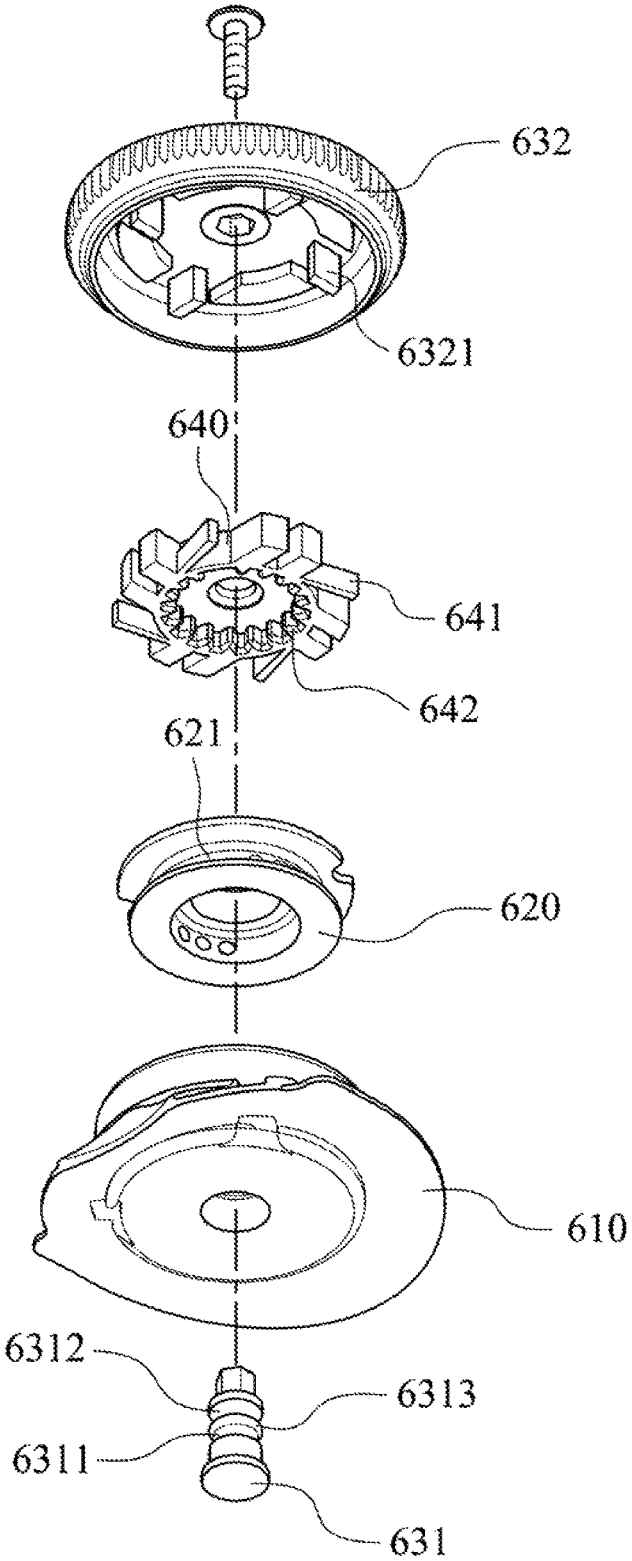
FIG. 11 is an exploded view showing the apparatus of FIG. 10.
Figure 12:
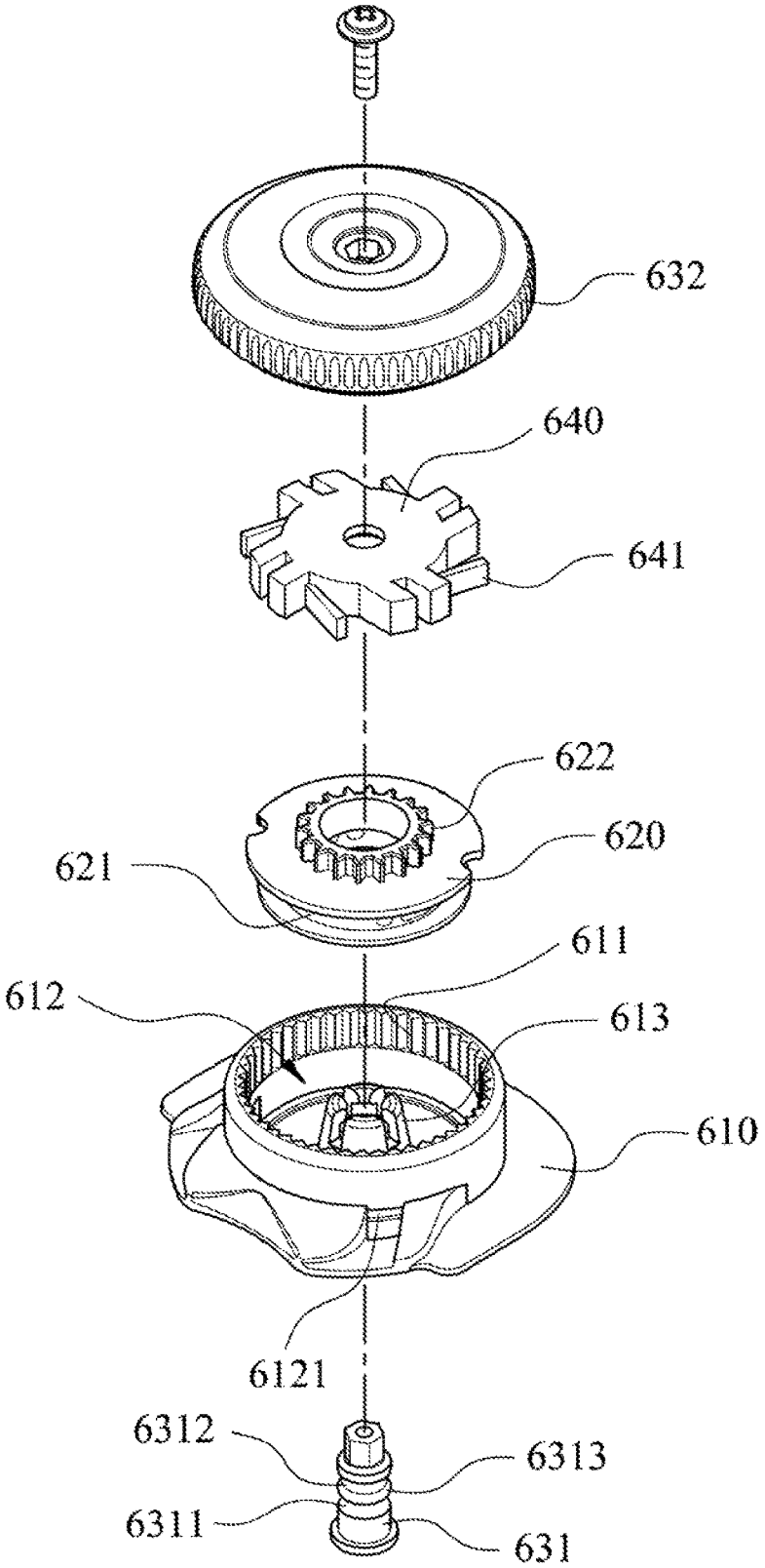
FIG. 12 is another exploded view showing the apparatus of FIG. 10.
Figure 13:
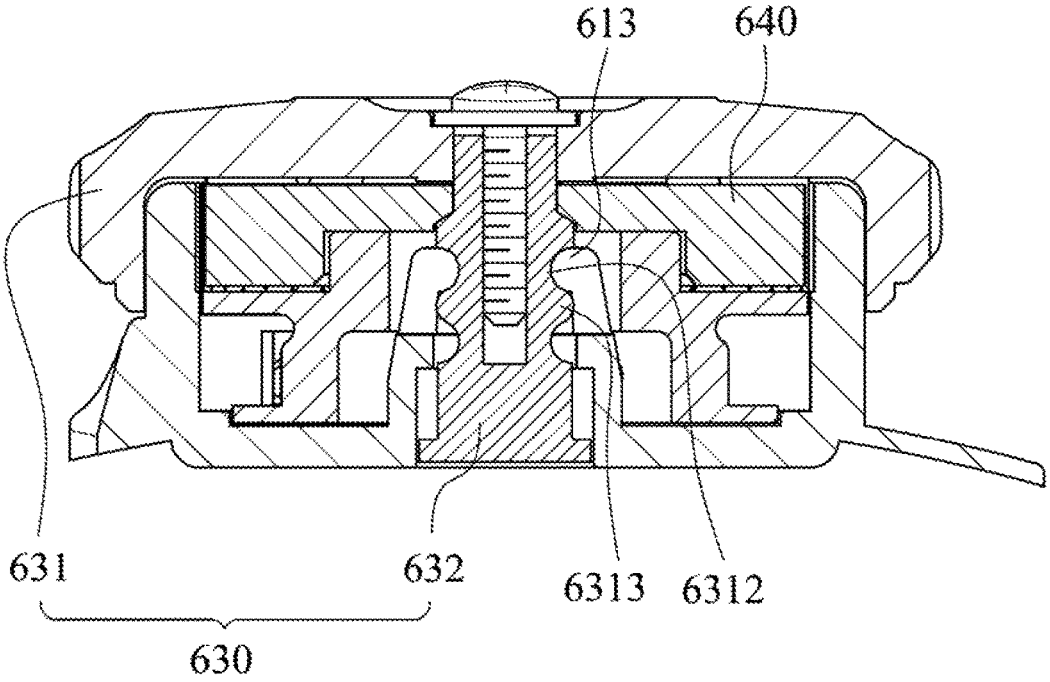
FIG. 13 is a cross-sectional view showing a releasing unit located in a first position of the apparatus of FIG. 10.
Figure 14:
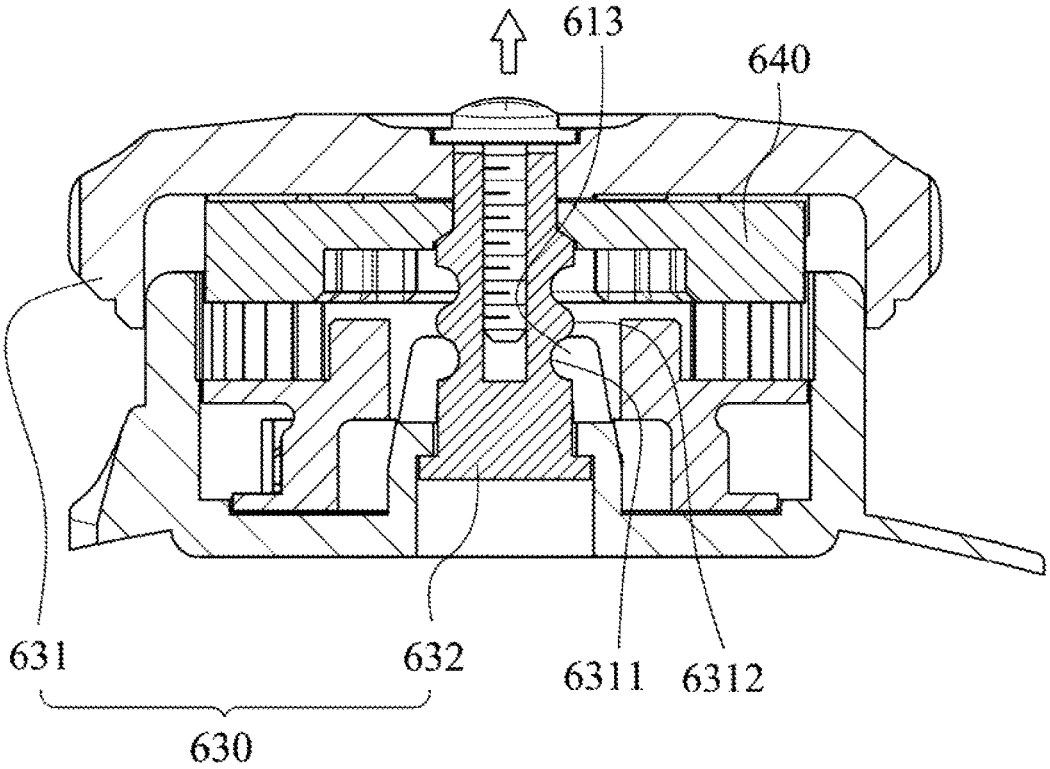
FIG. 14 is a cross-sectional view showing the releasing unit located in a second position of the apparatus of FIG. 10.
Figure 15:
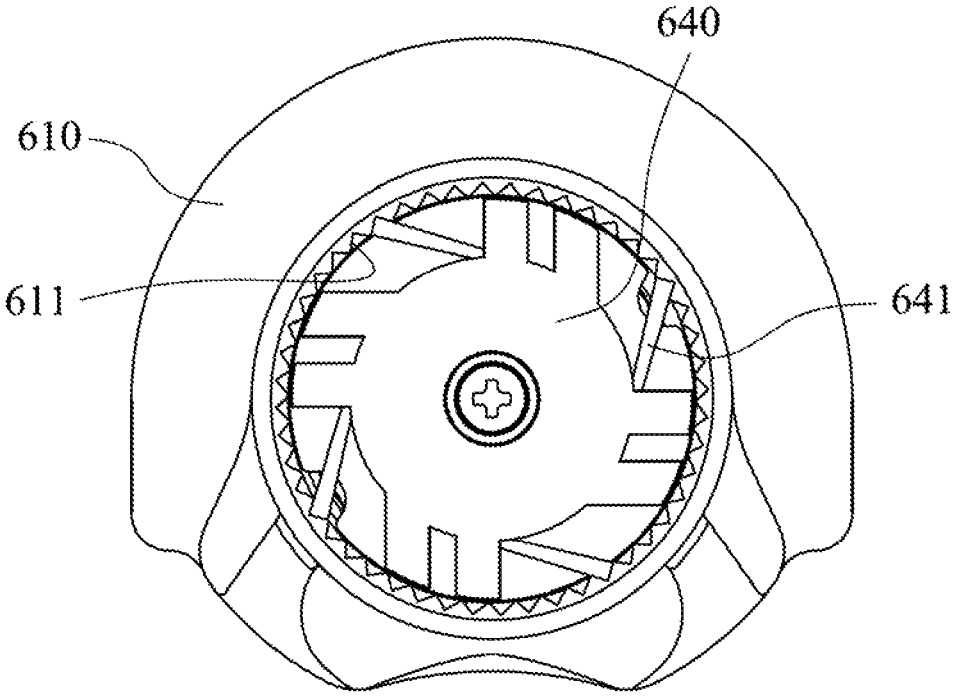
FIG. 15 is a schematic top view showing the apparatus of FIG. 10.

FIG. 10 is a schematic view showing an apparatus for tightening and loosening a lace according to another embodiment of the present disclosure; FIG. 11 is an exploded view showing the apparatus of FIG. 10; FIG. 12 is another exploded view showing the apparatus of FIG. 10; FIG. 13 is a cross-sectional view showing a releasing unit 630 located in a first position of the apparatus of FIG. 10; FIG. 14 is a cross-sectional view showing the releasing unit 630 located in a second position of the apparatus of FIG. 10; and FIG. 15 is a schematic top view showing the apparatus of FIG. 10. In FIGS. 10-15, the apparatus for tightening and loosening a lace includes a base 610, a lace tightening and loosening member 620, a releasing unit 630 and an interlocking member 640. The detailed structure of the apparatus is described as follows:

The base 610 has a plurality of base annular teeth 611, an accommodating space 612 and at least one stopping member 613. The accommodating space 612 is formed by a circular wall, and the base annular teeth 611 are disposed inside the circular wall and located in the accommodating space 612. The accommodating space 612 is communicated with an ambience by two lacing holes 6121.

The lace tightening and loosening member 620 is pivotally mounted in the accommodating space 612. The lace tightening and loosening member 620 includes an annular track 621 and a first combining portion 622. The annular track 621 is corresponding to the two lacing holes 6121, and the first combining portion 622 is surrounded by a plurality of teeth.

The releasing unit 630 includes a shaft member 631 and a rotating knob 632. The shaft member 631 is pivotally connected to the rotating knob 632 in the accommodating space 612, and the releasing unit 630 is operated by the user. A plurality of releasing annular teeth 6321 are disposed inside the rotating knob 632. The releasing unit 630 further includes a first positioning portion 6311, a second positioning portion 6312 and a temporary sliding portion 6313. The temporary sliding portion 6313 is disposed between the first positioning portion 6311 and the second positioning portion 6312, and the temporary sliding portion 6313 is passed through the stopping member 613 by a preliminary force.

The interlocking member 640 is rotatably positioned in the accommodating space 612. The interlocking member 640 includes an elastic abutting arm 641 and a second combining portion 642 having an annular tooth shape. The elastic abutting arm 641 is correspondingly engaged with the base annular teeth 611 and the releasing annular teeth 6321. The elastic abutting arm 641 is inclinedly extended outward from the interlocking member 640. When the stopping member 613 is positioned by the first positioning portion 6311, the releasing unit 630 is located at a first position, and the second combining portion 642 is correspondingly connected to the first combining portion 622. The elastic abutting arm 641 is engaged with one of the base annular teeth 611. Each of the elastic abutting arms 641 is correspondingly abutted by one of the releasing annular teeth 6321 in a radial direction. Each of the elastic abutting arms 641 is moved in the radial direction when base annular teeth 611 are rotated in the tightening direction. Accordingly, the elastic abutting arm 641 substantially stops the releasing unit 630 from rotating in the loosening direction and does not substantially stop the releasing unit 630 from rotating in the tightening direction. When the stopping member 613 is positioned by the second positioning portion 6312, the releasing unit 630 is located at the second position, and the second combining portion 642 is separated from the first combining portion 622.

When the releasing unit 630 is located at the first position, each of the elastic abutting arms 641 is abutted or released by the releasing annular teeth 6321. The elastic abutting arms 641 engaged with the base annular teeth 611 substantially stop from rotating in the loosening direction and do not substantially stop from rotating in the tightening direction. When the releasing unit 630 is rotated in the loosening direction, the elastic abutting arm 641 is elastically abutted by the releasing annular teeth 6321 to perform a progressive releasing operation. Therefore, the apparatus for tightening and loosening the lace can be easily assembled, easily operated without a function of an elastic unit. Moreover, the present disclosure can reduce complexity of the apparatus and the number of components, thereby decreasing the cost of the product.

Figure 16:
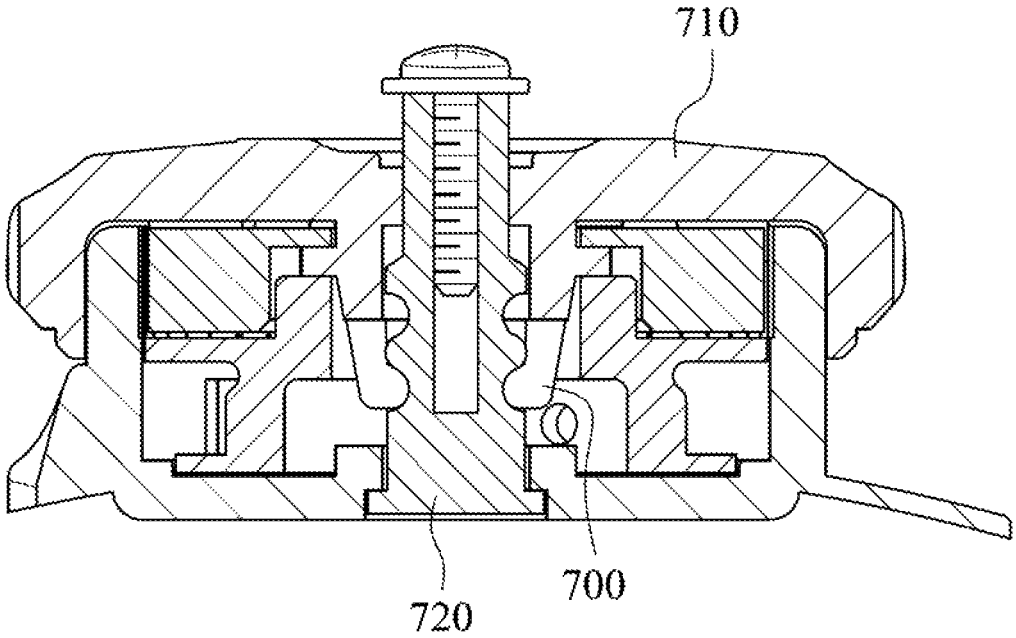
FIG. 16 is a cross-sectional view showing an apparatus for tightening and loosening a lace according to further another embodiment of the present disclosure.

FIG. 16 is a cross-sectional view showing an apparatus for tightening and loosening a lace according to further another embodiment of the present disclosure. In this embodiment, a position of a stopping member 700 is changed. The stopping member 700 is integrally connected to a rotating knob 710. A shaft member 720 is independent and pivotally connected to other components. Therefore, the stopping member 700 combined with the shaft member 720 can move the releasing unit 400 between the first position and the second position. The detailed description of the same configuration as the foregoing embodiment is omitted.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An apparatus for tightening and loosening a lace, comprising:

a base having an accommodating space and at least one stopping member, wherein the accommodating space is communicated with an ambience by two lacing holes;

a lace tightening and loosening member pivotally mounted in the accommodating space, wherein the lace tightening and loosening member comprises an annular track and a first combining portion, and the annular track is corresponding to the two lacing holes;

a releasing unit pivotally mounted in the accommodating space, wherein the releasing unit comprises a rotating knob, a plurality of annular teeth, a second combining portion, a first positioning portion, a second positioning portion and a temporary sliding portion, the temporary sliding portion is disposed between the first positioning portion and the second positioning portion, the temporary sliding portion is passed through the stopping member by a preliminary force, when the stopping member is positioned by the first positioning portion, the releasing unit is located at a first position, the second combining portion is correspondingly connected to the first combining portion, when the stopping member is positioned by the second positioning portion, the releasing unit is located at a second position, and the second combining portion is separated from the first combining portion; and an interlocking member fixedly disposed in the accommodating space, wherein the interlocking member comprises a plurality of elastic abutting arms corresponding to the annular teeth, when the releasing unit is located at the first position, the elastic abutting arms substantially stop the releasing unit from rotating in a loosening direction and does not substantially stop the releasing unit from rotating in a tightening direction;

wherein the annular teeth comprise a plurality of outer annular teeth and a plurality of inner annular teeth protruding toward the base, the elastic abutting arms are integrally connected to the interlocking member, each of the elastic abutting arms has a sliding block and a resisting end, the resisting end is configured to apply a blocking force to the inner annular teeth, and the sliding block connected to the resisting end substantially stops the inner annular teeth from rotating in the loosening direction and does not substantially stop the inner annular teeth from rotating in the tightening direction.

2. The apparatus for tightening and loosening the lace of claim 1, wherein, the interlocking member has a hollow ring shape, a plurality of elastic supporting seats are protrudingly disposed in the interlocking member at equal intervals, the elastic abutting arms are connected to the elastic supporting seats, respectively, and one of the elastic abutting arms connected to one of the elastic supporting seats is protrudingly formed along the interlocking member.

3. The apparatus for tightening and loosening the lace of claim 2, wherein, a plurality of concave portions are disposed around the accommodating space of the base; and a plurality of convex portions are protrudingly disposed on the interlocking member, and the convex portions are engaged with the concave portions, respectively.

4. The apparatus for tightening and loosening the lace of claim 1, wherein, each of the outer annular teeth has a stopping surface and an inclined surface, each of the inner annular teeth has an inclined stopping surface and an inclined releasing surface, and the stopping surface is opposite to the inclined stopping surface; and each of the sliding blocks is corresponding to the stopping surface and the inclined surface of each of the outer annular teeth, each of the resisting ends has two tilted surfaces corresponding to the inclined stopping surface and the inclined releasing surface of each of the inner annular teeth, and the elastic abutting arms are elastically deformed by the inclined surface or the inclined releasing surface.

5. An apparatus for tightening and loosening a lace, comprising:

a base having a plurality of base annular teeth, an accommodating space and at least one stopping member, wherein the accommodating space is communicated with an ambience by at least one lacing hole;

a lace tightening and loosening member pivotally mounted in the accommodating space, wherein the lace tightening and loosening member comprises an annular track and a first combining portion, and the annular track is corresponding to the lacing hole;

a releasing unit pivotally mounted in the accommodating space, wherein the releasing unit comprises a rotating knob, a first positioning portion, a second positioning portion and a temporary sliding portion, the temporary sliding portion is disposed between the first positioning portion and the second positioning portion, and the temporary sliding portion is passed through the stopping member by a preliminary force; and an interlocking member rotatably positioned in the accommodating space, wherein the interlocking member comprises an elastic abutting arm and a second combining portion, the elastic abutting arm is correspondingly engaged with the base annular teeth;

wherein when the stopping member is positioned by the first positioning portion, the releasing unit is located at a first position, the second combining portion is correspondingly connected to the first combining portion, the elastic abutting arm substantially stops the releasing unit from rotating in a loosening direction and does not substantially stop the releasing unit from rotating in a tightening direction;

wherein when the stopping member is positioned by the second positioning portion, the releasing unit is located at a second position, the second combining portion is completely or partially separated from the first combining portion, and the interlocking member is not corresponding to the base annular teeth.

6. The apparatus for tightening and loosening the lace of claim 5, wherein, the accommodating space is formed by a circular wall, and the base annular teeth are disposed inside the circular wall;

the releasing unit further comprises a shaft member pivotally connected to the rotating knob in the accommodating space, a plurality of releasing annular teeth are disposed inside the rotating knob, and the first positioning portion and the second positioning portion are disposed on the shaft member of the releasing unit; and the second combining portion of the interlocking member has an annular tooth shape, and the elastic abutting arm is corresponding to the releasing annular teeth and inclinedly extended outward from the interlocking member;

wherein when the stopping member is positioned by the first positioning portion, the elastic abutting arm is engaged with one of the base annular teeth, and each of the elastic abutting arms is correspondingly abutted by one of the releasing annular teeth in a radial direction;

wherein when the stopping member is positioned by the second positioning portion, the releasing unit is located at the second position, and the second combining portion is completely or partially separated from the first combining portion.

7. An apparatus for tightening and loosening a lace, comprising:

a base having an accommodating space communicated with an ambience by two lacing holes;

a shaft member disposed on the base and having a first positioning portion, a temporary sliding portion and a second positioning portion;

a lace tightening and loosening member pivotally connected to the shaft member and mounted in the accommodating space, wherein the lace tightening and loosening member comprises an annular track and a first combining portion, and the annular track is corresponding to the two lacing holes;

a releasing unit pivotally mounted in the accommodating space with the lace tightening and loosening member, wherein the releasing unit and the lace tightening and loosening member are pivotally mounted on the shaft member, the releasing unit comprises a rotating knob, at least one stopping member, a plurality of annular teeth and a second combining portion, the rotating knob is configured to operate in an axial reciprocating motion, the temporary sliding portion is passed through the stopping member by an axial preliminary force, when the stopping member is positioned by the first positioning portion, the releasing unit is located at a first position, the second combining portion is correspondingly connected to the first combining portion, when the stopping member is positioned by the second positioning portion, the releasing unit is located at a second position, and the second combining portion is separated from the first combining portion; and an interlocking member fixedly disposed in the accommodating space, wherein the interlocking member comprises an elastic abutting arm corresponding to the annular teeth, the elastic abutting arm is configured to operate in the axial reciprocating motion, when the releasing unit is located at the first position, the elastic abutting arm substantially stops the releasing unit from rotating in a loosening direction and does not substantially stop the releasing unit from rotating in a tightening direction;

wherein the annular teeth comprise a plurality of outer annular teeth and a plurality of inner annular teeth protruding toward the base, the elastic abutting arm is integrally connected to the interlocking member, the elastic abutting arm has a sliding block and a resisting end, the resisting end is configured to apply a blocking force to the inner annular teeth, and the sliding block connected to the resisting end substantially stops the inner annular teeth from rotating in the loosening direction and does not substantially stop the inner annular teeth from rotating in the tightening direction.

* * * * *